United States Patent [19]

Tomsin

[11] Patent Number: 4,730,427

[45] Date of Patent: Mar. 15, 1988

[54] SHUTTERING AND SHORING WALL

[75] Inventor: Michel Tomsin, Evegnée, Belgium

[73] Assignees: Compagnie Francois d'Entreprises CFE S.A., Brussels; Compagnie Internationale des Pieux Armes Frankignoul S.A., Liege, both of Belgium

[21] Appl. No.: 866,048

[22] Filed: May 22, 1986

[30] Foreign Application Priority Data

May 28, 1985 [FR] France ..... 85 07988

[51] Int. Cl.[4] ..... E04B 1/32

[52] U.S. Cl. ..... 52/245; 405/151; 405/152

[58] Field of Search ..... 52/245, 248, 580, 588; 405/146, 150, 151, 152, 153

[56] References Cited

U.S. PATENT DOCUMENTS

| | | | |
|---|---|---|---|
| 1,197,140 | 9/1916 | Mathews | 52/245 |
| 3,102,367 | 9/1963 | Pedersen et al. | 52/245 |
| 3,488,965 | 1/1970 | Chesnov | 405/151 |
| 3,707,846 | 1/1973 | Leblond et al. | 405/152 |
| 3,710,581 | 1/1973 | Wong | 405/151 |
| 3,783,625 | 1/1974 | Gantke et al. | 405/152 |
| 4,099,388 | 7/1978 | Hüsemann et al. | 405/141 |
| 4,454,693 | 6/1984 | Price | 52/248 |

*Primary Examiner*—Carl D. Friedman
*Assistant Examiner*—Creighton Smith
*Attorney, Agent, or Firm*—Pennie & Edmonds

[57] ABSTRACT

The invention relates to the construction of tunnels.

Its subject is a shuttering and shoring wall formed by joining end to end sections (1) which each consists of at least two section parts (2, 3, 4, 5) joined together end to end, the ends facing one another being connected by means of a key (6). Each section part consists of a certain number of elements articulated relative to one another. The key has two lateral insertion surfaces, and the end elements adjacent to the latter are equipped with assembly means compatible with these insertion surfaces.

The advantage of the shuttering wall according to the invention is that it consists of elements which can be adapted to any tunnel shape and which can be recovered after use, is easy to handle, makes it possible to transmit longitudinal and transverse forces generated as a result of the advance of the shield of the tunnel-driving machine and the casting of the concrete and does not require the use of a shuttering skin.

19 Claims, 16 Drawing Figures

Fig. 4.
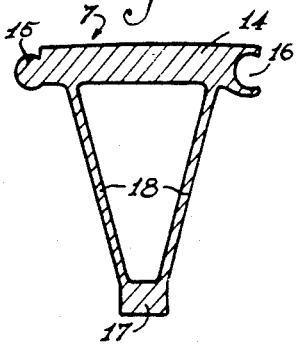
Fig. 5.
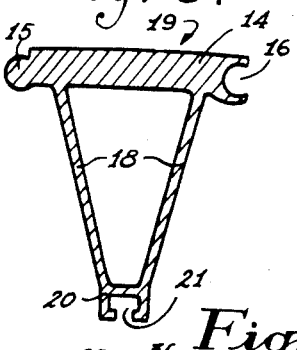
Fig. 6.
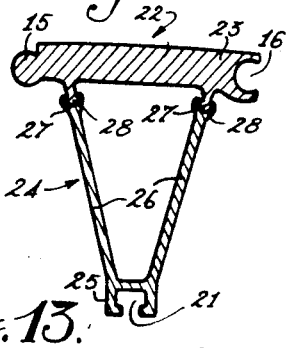
Fig. 13.
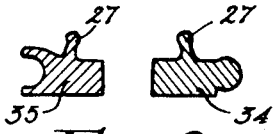
Fig. 9.
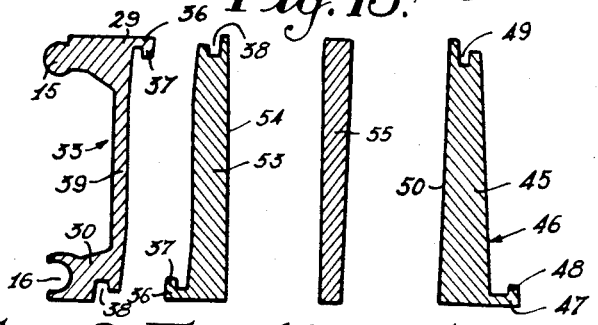
Fig. 8. Fig. 12. Fig. 11
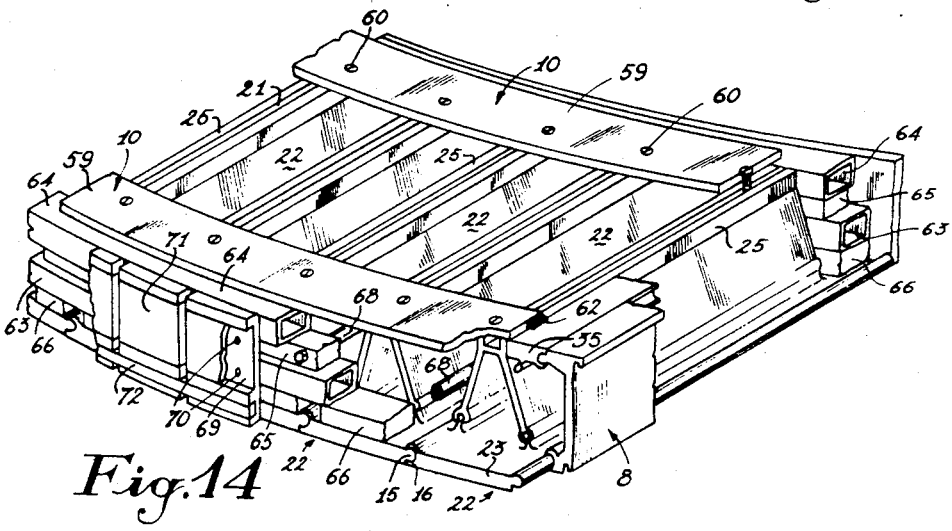
Fig. 14

SHUTTERING AND SHORING WALL

The present invention relates to a wall for constructing shuttering for the in situ casting of concrete to produce shells, slabs and (tunnel) arches, and also intended for the shoring of soil, that is to say to contain the earth during the digging of trenches or other earthmoving work.

The present invention will be described below with reference to its preferred use which is to construct shuttering for producing tunnel linings consisting of concrete cast in situ and, more particularly, for tunnels made during underground exploratory work.

The execution of tunnels of this type, with a lining consisting of concrete cast in situ, is well known and involves digging a tunnel section, usually by means of a drilling machine, and producing the lining by pumping fresh concrete into the free space between the shield of the machine, which advances in the driving direction, and the fitted shuttering. The shield is driven in the driving direction usually by means of thrust jacks acting parallel to the axis of the tunnel. These generally bear on the tunnel lining already cast.

Now, in practise, the lining is produced at the same work rate as the driving of the tunnel, by pumping fresh concrete into the free space between the shield of the machine and the concrete already cast, which is in the process of setting and is retained by the fitted shuttering.

It is therefore impossible to bear on the freshly cast concrete as long as it has not attained a given resistance, and this entails a loss of time in the progress of the work.

To avoid this loss of time, it is advantageous if the advance jacks bear on the tunnel lining by interposition of the fitted shuttering. The longitudinal driving forces of the shield are thus transmitted as a result of friction between the said shuttering and the concrete in the tunnel lining, thereby making it possible to work with a finite length of shuttering which can be removed when the concrete has set.

An example of a process and of a machine for the continuous production of a tunnel lining consisting of concrete cast in situ and compressed is described in Belgian Pat. No. 838,048.

The shuttering for producing a cast-concrete lining obviously has to follow the inner profile of the tunnel to be made, although a gap is provided between the outer surface of the shuttering (the shuttering surface) and the cleared earth.

The tunnels have either a polygonal, especially rectangular, cross-section or, more generally, a cross-section having cambered, particularly circular, parts which, for example, correspond to the tunnel arch.

The shuttering for producing a tunnel lining usually consists of sections joined together end to end. Each of these shuttering sections therefore has at least one cambered part which, for example, corresponds to the tunnel arch.

Furthermore, each section consists of at least two parts joined together end to end in a rigid or articulated manner, so that the joint edges are parallel to the axis of the section (and of the tunnel), in order to make it easier to transport it and carry out all the operations to instal it inside the tunnel. At least one of these parts therefore has a curved portion.

In a known way, the parts forming the shuttering sections are made of cast iron, steel or concrete. These parts are consequently heavy and bulky and are therefore difficult to handle and have a fixed unchangeable cambered shape.

The use of this type of shuttering is therefore limited to tunnels having a cross-section of specific shape; in particular, the section parts cambered according to a specific radius of curvature are only suitable for tunnels which have arches of the same radius of transverse curvature.

This type of shuttering is consequently incompatible with shapes which take any form and which can be changed, whether during the production of one and the same tunnel of variable cross-section or for tunnels having different cross-sections and profiles.

There are also known shuttering sections which consist of wooden or metal beams arranged parallel to the axis of the tunnel and fastened to a flexible outer sheet having a smooth surface, against which the concrete will be cast (shuttering surface), made of wood, multiplex, steel or aluminum and consisting of bent or flexible panels or of contiguous elements of small width. Transverse ties connect the beams to one another and ensure the transverse rigidity of the assembly as a whole.

However, the use of this type of shuttering to produce a cast-concrete tunnel lining requires the presence of a supporting structure fitted inside each section of the shuttering, since it is impossible for the outer sheet alone to absorb the transverse compressive forces generated as a result of the casting of concrete under pressure, because it has to be sufficiently fine and flexible to match a desired curvature.

Moreover, this type of shuttering cannot be used to produce a concrete lining cast at the same work rate as the driving of the tunnel.

In fact, the construction of this type of shuttering does not allow the driving forces of the shield to be transmitted to the lining as a result of friction between the shuttering and the concrete, since the fastening of the longitudinal beams (on which the shield advance jacks would have to bear) to the outer sheet (shuttering surface in contact with the concrete) will not withstand the shearing forces.

Inflatable shuttering is also known, and this consists of a cylindrical casing which is made of rubber reinforced with synthetic fibers and into which air is injected under pressure and round which the concrete is cast.

As soon as the concrete has set sufficiently, the air is evacuated from the casing, and the latter is extracted along the axis of the conduit.

However, inflatable shuttering is limited to the production of cylindrical conduits having a diameter not exceeding 3 meters. Furthermore, since the presence of a synthetic-fiber reinforcement makes it impossible to vary the diameter of a shuttering of this type to any appreciable extent, each casing can only be used for a specific conduit diameter. Finally, the presence of the inflatable casing in the latter, as long as the concrete has not set sufficiently, prevents any activity in the conduit, in particular the continuation of the cutting work. Moreover, it should be noted that inflatable shuttering is preferably used in surface trenches, the concrete being cast from outside, between the cleared earth and the surface of the casing and serves above all for producing sections of relatively long lengths (up to 30 meters), but of relatively small crosssections, for example drainpipes, etc.

The object of the present invention is to provide a shuttering and shoring wall which is easy to handle and install, and which, whilst allowing the transmission of both transverse and longitudinal compressive, tensile and shearing forces generated as a result of the advance of the shield of the tunnel-driving machine and as a result of the casting and setting of the concrete, is constructed from a maximum of recoverable standard elements capable of being used repeatedly, does not require the use of an additional shuttering skin and can be matched to all the desired shapes and all the dimensions of tunnels by varying the number of standard elements used.

To achieve this, the standard elements are of relatively small dimensions and weights and consequently can easily be handled by manpower and therefore without resorting to lifting appliances, etc.

The configuration of these standard elements and their method of assembly make it possible to transmit the various stresses, both longitudinal and transverse, such as, for example, the driving forces of the shield of a tunnel-drilling machine or the transverse compressive forces generated as a result of the casting of concrete under pressure.

The possibility of varying the number of standard elements assembled allows the dimensions of the wall to be set exactly according to requirements; thus, for example, the length of the perimeter of a shuttering section used for producing the lining of a tunnel can be matched exactly to the inner dimensions of the tunnel, in order to obtain the desired lining thickness exactly.

Furthermore, the standard elements used are assembled in such a way that they intermesh and by themselves produce a sufficiently uniform shuttering wall, against which the concrete will be cast.

Finally, the method of assembling the standard elements is designed to form a joint about an axis running along the joined edges of two contiguous elements, thus making it possible for a shuttering wall consisting of these elements to match the transverse curvature of the tunnel exactly.

The present invention also allows the passage of fluid for heating and cooling the shuttering wall, thus making it possible to accelerate or regulate the setting of the concrete.

The subject of the present invention is a shuttering and shoring wall which is formed by joining sections together end to end by means of their end faces, each section having at least one cambered part, the generatrix of which is parallel to the axis of the section, each section consisting of at least two section parts joined together end to end, so that the joining edges are parallel to the axis of the section, and of at least one key inserted between the surfaces of the ends of two section parts facing one another. Each section part itself consists of a certain number of identical main elements and, at each of its ends, of an end element and connection and locking means Each main element comprises a substantially rectangular shuttering plate, one face of which forms the shuttering surface, and a stiffening core which is spaced from the shuttering plate and is located on the same side as the face opposite the shuttering surface and which is connected rigidly to the shuttering plate; the plate is equipped, along two edges parallel to one another and to the axis of the section, with means of junction with the edge of the adjacent plates; these junction means form a joint about an axis running along the joined edges. Each end element likewise comprises a substantially rectangular shuttering plate, one face of which forms the shuttering surface, and a stiffening plate which is spaced from the shuttering plate and is located on the same side as the face opposite the shuttering surface and which is connected rigidly to the shuttering plate by means of a web, and each end element is attached to the shuttering plate of the last main element of a section part by a junction means and, on the free end face, it is profiled so as to allow connection and attachment to the end element of an adjacent section part; the connection and locking means connect the stiffening cores and stiffening plates so as to keep all the elements of one and the same section part locked in a specific position relative to one another; the key likewise has a shuttering surface and two lateral insertion surfaces, and the adjacent end elements of the key are equipped with means of joining them to the key, which are compatible with the lateral insertion surfaces of the latter, so as to allow the key to be inserted with the shuttering surface at the front.

According to an advantageous embodiment, the junction means connecting the shuttering plates of the main elements to one another and to the shuttering elements of the end elements of one and the same section part comprise, on the one hand, a solid cylindrical tongue and, on the other hand, the hollow cylindrical imprint of the same tongue, the shuttering plates of two adjacent elements being assembled together by fitting a tongue of one element into the hollow imprint of an adjacent element in a direction parallel to the axis of the section.

According to a preferred embodiment, the shuttering plate of a main element carries a solid cylindrical tongue along one of the two parallel edges and the hollow cylindrical imprint of the same tongue along the other edge.

According to an advantageous embodiment, the stiffening core is connected to the shuttering plate by means of two connecting elements which are arranged in the form of a V and which can be either solid webs are reticular structures.

The connecting elements and the stiffening core form an integral V-shaped structure.

According to a preferred embodiment, the shuttering plate carries, on its face opposite the shuttering surface, two parallel ribs equipped with a solid cylindrical tongue along their free edge, and the free edge of each of the connecting elements of the integral V-shaped structure is provided with a hollow imprint of the said tongue, the fitting of the said two tongues in the said imprints thus making it possible to assemble a main element.

The shuttering plate can be connected to the integral V-shaped structure by means of either welding or bonding.

According to a preferred embodiment, the stiffening core has a groove-shaped longitudinal slot intended for receiving a nut for fastening to the connecting and locking elements which connect the various stiffening cores to one another.

The end elements are profiled in such a way as to make it possible to attach them to one another in the direction towards the shuttering surfaces, both along the edge of the shuttering plate and along the edge of the stiffening plate.

Preferably, on one of the end elements, the means of attachment along the edge of the shuttering plate consists of a rib provided with a rim, and the means of attachment along the edge of the stiffening plate consists of a notch, and on the other end element the means of attachment along the edge of the shuttering plate consists of a notch intended for receiving the rim of the first end element, and the means of attachment along the edge of the stiffening plate consists of a rib provided with a rim intended to be engaged in the notch of the first end element.

According to a preferred embodiment, each of the end elements consists of one and the same structural piece comprising two plates which are connected by means of a web perpendicular to them and of which one forms the shuttering plate and the other is joined to a matching connecting plate to form the stiffening plate; along their edges located on the same side as the main element, one of the two plates has a solid longitudinal tongue and the other the hollow imprint of the same tongue. Furthermore, along their edges on the side where the elements are attached to one another, one of the two plates has a rib provided with a rim and the other has a notch; the said structural piece thus makes it possible, by being rotated through 180°, equally to join it to a shuttering plate of a main element having either an imprint or a tongue and attach two end elements to one another.

According to an advantageous embodiment, the key consists of a main element and two end elements, each carrying a plate, one face of which forms the sliding surface allowing the key to be inserted; each plate is connected to the nearest end element by means of an intermediate plate, one of the faces of which is equipped with means of attachment to this end element.

On the other hand, the means of joining the end elements to the key each consist of a plate, one face of which forms a sliding surface compatible with one of the sliding surfaces of the key, and of an intermediate plate allowing attachment to the nearest end element.

The prefabricated elements used for the shuttering wall according to the present invention can be made of various materials, namely metal, for example aluminum or its alloys, cast iron or steel, polymer materials reinforced or not, or fibro-cement.

The present invention will be described below in its preferred use which involves the production of a tunnel lining, more particularly a tunnel of circular crosssection, with reference to the attached Figures in which:

FIG. 4 is a cross-section through an embodiment of a main element;

FIG. 5 is a cross-section through another embodiment of a main element;

FIG. 6 is a cross-section of another embodiment of a main element;

FIG. 8 is a cross-section through a structural piece forming an end element;

FIG. 9 is a cross-section through two connecting plates, each forming an end element;

FIG. 11 is a cross-section through a plate making it possible to insert the key between two section parts;

FIG. 12 is a cross-section through an intermediate plate making the connection between an end element and the plate of FIG. 11.

FIG. 13 is a cross-section through a thickness plate making it possible to set exactly the lengths of the section parts and the key;

FIG. 14 is a perspective view, partially cut away, of a section part;

Figure 1:
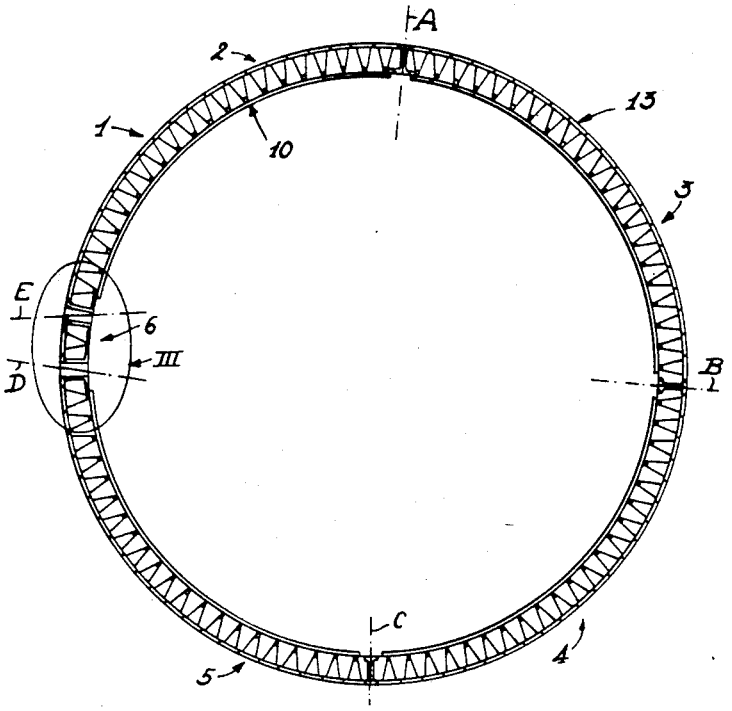
FIG. 1 is a diagrammatic cross-section on a reduced scale of an assembled shuttering section.

FIG. 1 is a diagrammatic cross-section on a reduced scale through a shuttering section designated as a whole by 1 and formed by joining together end to end, along the contour of the section 1, section parts 2, 3, 4 and 5 and a key 6 which is inserted between the section parts 2 and 5. To make the description easier, the section 1 illustrated has a circular cross-section, but it goes without saying that the present invention can be adapted to suit any tunnel cross-sections.

The section parts 2, 3, 4 and 5 are joined together along the planes A, B and C parallel to the axis of the section and passing through this axis. The key 6 is inserted between the mutually facing ends of the section parts 2 and 5, to close the circumference of the shuttering wall, along the planes D and E which are parallel to one another or which, in an extreme case, even converge slightly from the inside of the tunnel towards the outside, as illustrated, to make it easier to insert the key 6 and lock the shutter-ring 1 in place.

The shuttering section 1 has a continuous shutter-ring surface 13, against which the concrete lining will be cast.

Figure 2:
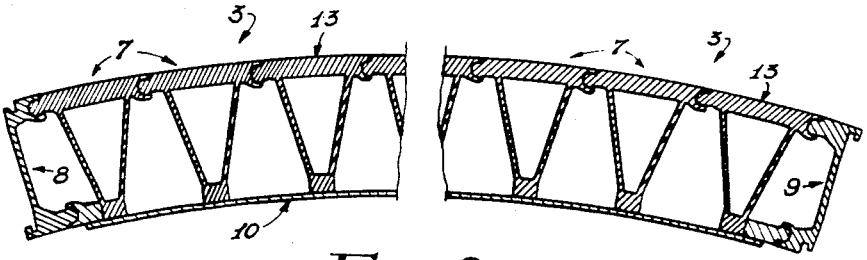
FIG. 2 shows a cross-section through a section part on a larger scale and partially cut away.

FIG. 2 shows, on a larger scale and partially cut away, a cross-section through a section part 3 (or 4, since the parts 3 and 4 are identical) formed by joining a certain number of main elements 7 end to end and having an end element 8 at one end and an end element 9 at the other, these end elements 8 and 9 making it possible to join it to the nearest end element 8, 9 of an adjacent section part. Each element 7 has a plate 14, of which the edges parallel to the axis of the section are equipped with junction means allowing articulation relative to adjacent elements. These junction means comprise a solid cylindrical tongue 15 which is located on one edge of a plate 14 and which fits perfectly into the hollow imprint 16 of an adjacent plate 14, forming a hinge about an axis running along the joined edges. The end elements 8 or 9 fit into the edges of the plates 14 in the same way. To join the elements 17 to one another or to the end elements 8 or 9, a solid tongue 15 is introduced into a hollow imprint 16. The various elements 7, 8 and 9 are fixed rigidly to one another by connection and locking means 10, as will be described later.

An entire section part, for example 2, can be assembled by positioning the elements 7 on a template having the shape of the intended shuttering surface; the elements 7 are fitted to one another, the end elements 8 and 9 are subsequently introduced at each end, and the assembly as a whole is secured by the connection and locking means 10.

Figure 3:
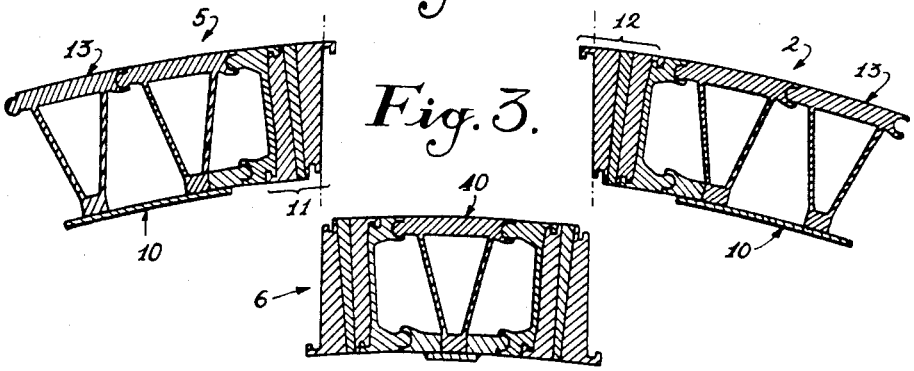
FIG. 3 shows, on a larger scale, a cross-section through the region of the key designated by III in FIG. 1.

FIG. 3 shows, in cross-section, the region of the section 1 incorporating the key 6, which is designated by III in FIG. 1 and which illustrates the mutually facing ends of the section parts 2 and 5 and the key 6 (for greater clarity, the latter is shown at a distance from its insertion position). The illustrated ends of the section parts 2 and 5 are equipped with means 11 and 12 of joining them to the key 6, respectively, and making it possible to insert the key 6.

FIG. 4 shows a cross-section through a main element 7 on a larger scale.

The element 7 also has a stiffening core 17 of rectangular cross-section, which is offset towards the inside of the tunnel in relation to the said plate 14. The stiffening core 17 is connected to the plate 14 by means of webs 18 and ensures the rigidity of the element 7. Furthermore, the stiffening core 17 makes it possible to join the element 7 to the connection and locking means 10, for example by means of welding or bonding, or bolting, as illustrated.

FIG. 5 shows a cross-section through another embodiment of the main element. The identical parts bear the same reference numerals as in the main element 7 of FIG. 4. The element 19 illustrated in FIG. 5 has a stiffening core 20 possessing a longitudinal slot 21, the profile and dimensions of which are intended for receiving a nut of a screw (which are not shown), ensuring assembly with the connection and locking means 10.

FIG. 6 shows a cross-section through a third embodiment of the main element. The element 22 illustrated is composed, on the one hand, of a plate 23 and, on the other hand, of a part designated as a whole by 24 and comprising a stiffening core 25 provided with a slot 21 and two webs 26; the plate 23 and the part 24 are joined together rigidly by fitting grooves having longitudinal tongues 27 integral with the plate 23 into the hollow imprints 28 of these tongues arranged along the free edges of the webs 26.

Figure 7:
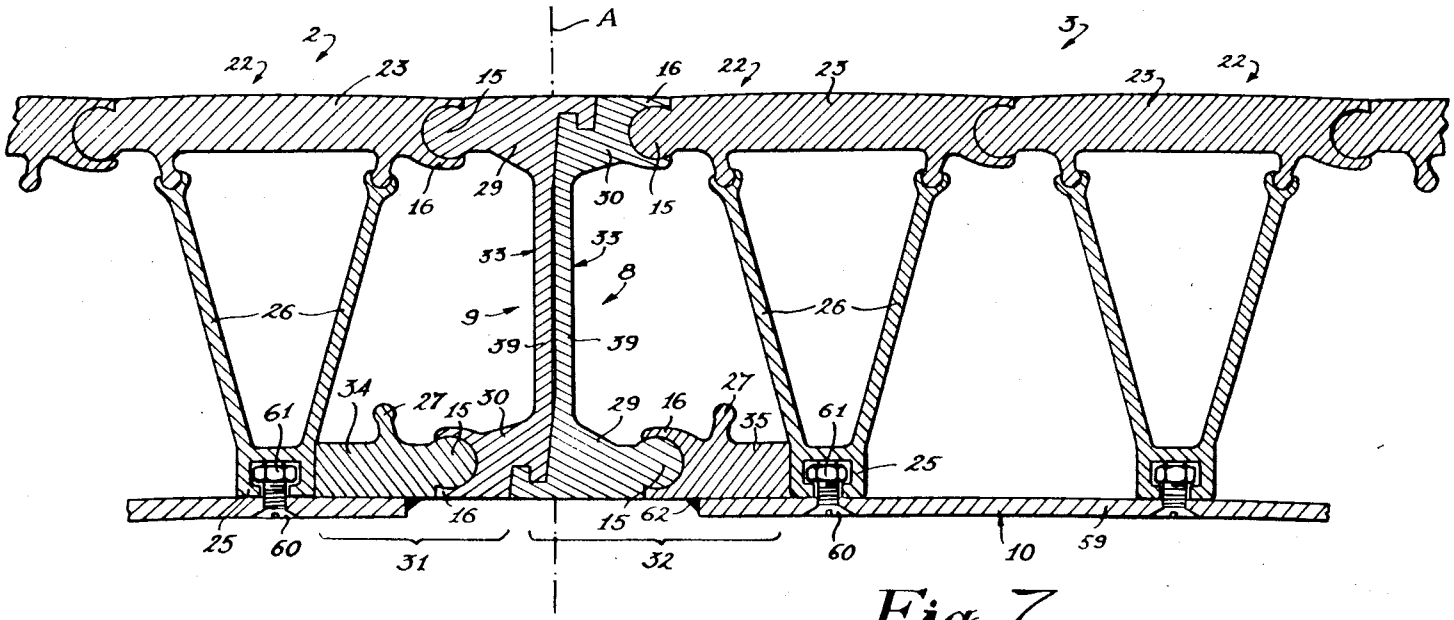
FIG. 7 shows, on a larger scale, the assembly of two successive section parts in the plane A of FIG. 1.

FIG. 7 shows, in cross-section and, on a larger scale, the assembly of the section parts 2 and 3 in the plane A of FIG. 1. These section parts 2 and 3 are joined to one another by means of the respective end elements 9 and 8. On the shuttering side, the end element 9 has a shuttering plate 29, the shuttering surface of which is substantially rectangular. One of the edges of this plate 29 is equipped with a cylindrical tongue 15 which fits into the hollow imprint 16 in the edge of the adjacent plate 23. The other edge is equipped with an attachment means. Likewise, the end element 8 has a shuttering plate 30. One of its edges is provided with a hollow imprint 16 intended for receiving the cylindrical tongue 15 of the edge of the adjacent plate 23. The other edge is equipped with an attachment means, compatible with the attachment means of the shuttering plate 29 of the end element 9.

On the inside, the end element 9 has a substantially rectangular stiffening plate 31. One of the edges of this plate 31 bears against the stiffening core 25 of the adjacent main element 22. The other edge is equipped with an attachment means. Likewise, the end element 8 has a substantially rectangular stiffening plate 32. One of the edges bears against the stiffening core 25 of the adjacent main element 22. The other edge is equipped with an attachment means compatible with the attachment means of the stiffening plate 31 of the end element 9.

The attachment means of the shuttering plates 29, 30 and the attachment means of the stiffening plates 31, 32 are designed to make it possible to attach the end of the section part 3 to that of the section 2 (already installed) from the inside of the tunnel towards the cleared earth.

As shown in FIG. 7, the end element 9 consists of a structural piece 33 joined to a connecting plate 34. Likewise, the end element 8 consists of an identical structural piece 33 which is, however, rotated through 180° and is joined to a connecting plate 35.

The structural piece 33, the cross-section of which is shown in FIG. 8, consists of two plates 29 and 30 and a web 39. The plate 29 is equipped on one side with a cylindrical tongue 15 and on the other side with an attachment means consisting of a rib 36 provided with a rim 37. The plate 30 is provided on one side with a hollow cylindrical imprint 16 and on the other side with an attachment means consisting of a notch 38 matching the rim 37. The two attachment means are on the same side. The opposite outer surfaces of the plates 29 and 30 are plane and parallel. The plate 29 is connected to the plate 30 by means of a web 39 perpendicular to these surfaces.

In FIG. 7, the structural piece 33 forms part of the end element 9. It is oriented so as to fit the cylindrical tongue 15 of its plate 29 into the hollow imprint 16 of the adjacent main element 22, and its plate 30 receives in its hollow imprint 16 the cylindrical tongue 15 of the adjacent main element.

The plate 29 of the structural piece 33 forms the shuttering plate 29, and the plate 30 of the structural piece 33, joined to the connecting plate 34, forms the stiffening plate 31.

Where the end element 8 is concerned, in contrast the structural piece 33 is rotated through 180° so as to present the hollow imprint 16 of its plate 30 opposite the cylindrical tongue 15 of the adjacent main element 22, and its plate 29 having a cylindrical tongue 15 is connected to the core 25 of the same main element 22 by means of a connecting plate 35 having a hollow imprint 16.

Here, the plate 30 of the structural piece 33 forms the shuttering plate 30, and the plate 29 of the structural piece, joined to the connecting plate 35, forms the plate 32.

In fact, the connecting plates 34 and 35 are obtained by being cut out from a shuttering plate 23. FIG. 9 illustrates the two connecting plates 34 and 35, and it will be noted here that there are again two assembly ribs 27 for the element 22 (see FIG. 6).

Figure 10:
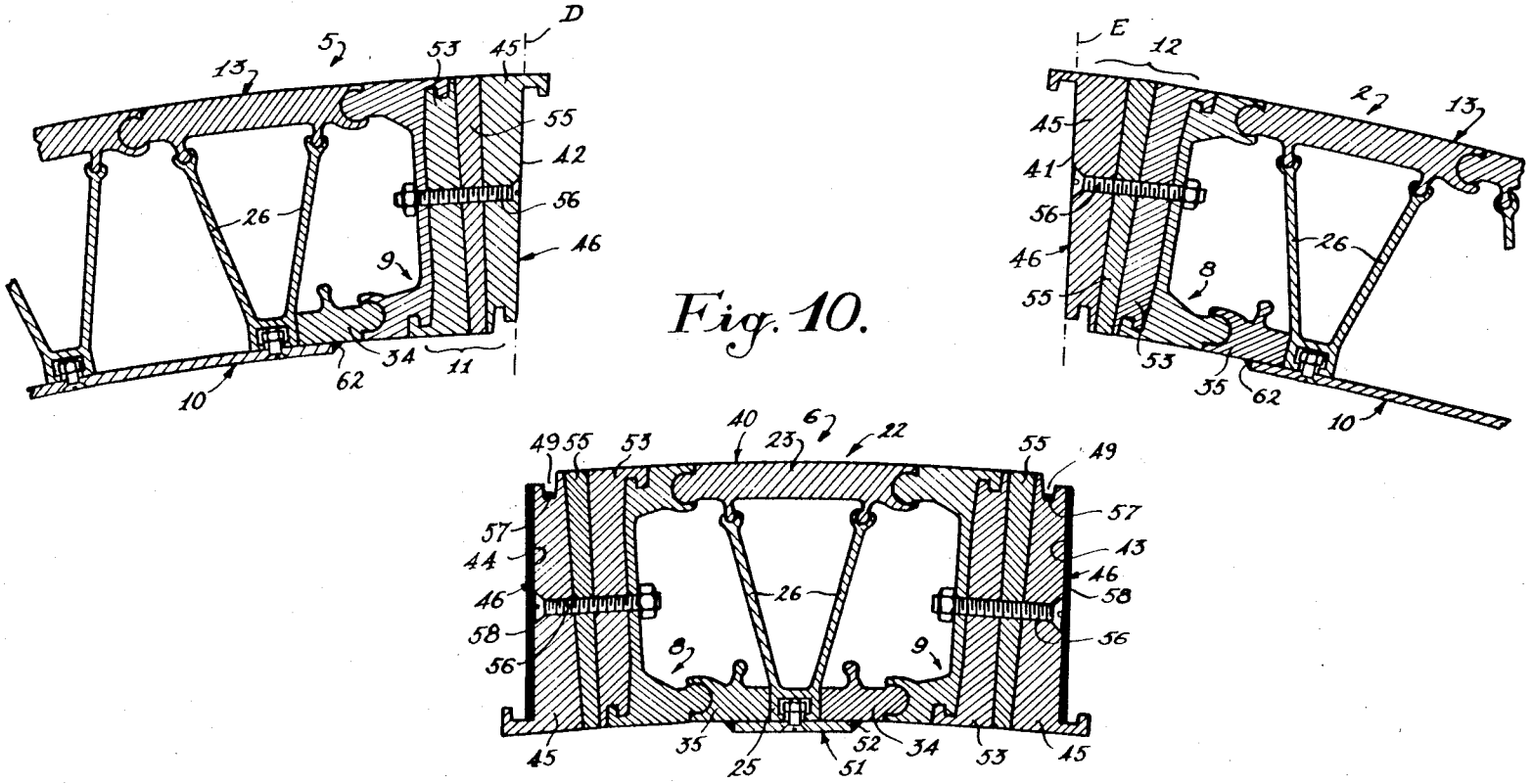
FIG. 10 is a cross-section, on a larger scale, through the region of the section incorporating the key.

FIG. 10 shows, in cross-section and on a larger scale, the assembly of the section parts 2 and 5 in the planes D and E of FIG. 1. In fact, FIG. 10 is similar to FIG. 3, but is on a larger scale. It illustrates the method of inserting the key 6 between the ends of the section parts 2 and 5.

As already explained above in relation to FIG. 7, the section parts 2, 3, 4 and 5 are attached to one another by first installing a section part and then attaching to its end one end of the following section part from the inside of the tunnel towards the shuttering surface and the cleared earth. On the other hand, the key 6 forming the final element for assembling the shuttering section has to be inserted between the mutually facing ends of the section parts 2 and 5, by means of its two ends at the same time, from the inside of the tunnel towards the cleared earth, with the shuttering surface 40 at the front.

For this purpose, the ends of the section parts 2 and 5, between which the key 6 is to be inserted, have respective surfaces 41 and 42 intended to allow the key 6 to be inserted from the inside of the tunnel towards the cleared earth.

Likewise, the key 6 has, at its ends, surfaces 43 and 44 matching the surfaces 41 and 42.

The key 6 is inserted by simultaneously sliding the surface 43 on the surface 41, on the one hand, and the surface 44 on the surface 42 on the other hand, in planes D and E which are parallel to one another or which converge from the inside of the tunnel towards the cleared earth.

In FIG. 10, the ends of the section parts 2 and 5 and the ends of the key 6 are equipped with plates 45 arranged so that one of their large faces is in the joining plane D or E and thus forms a sliding surface 41, 42, 43, 44. This large face 46 (see FIG. 11) is bordered on one side by a rib 47 provided with a rim 48 and on the other side by a notch 49 representing the hollow imprint of the rim 48. The other large face 50 is plane.

The plates 45 for each of the two insertion planes D and E and arranged one at the end of a section part and the other at the end facing the key 6 (FIG. 10) are oriented so that their large faces 46 are opposite one another. They will thus form the pairs of sliding surfaces 41–43 and 42–44. The profiles of these large faces 46 match one another, and the rims 48 engage into the notches 49 located opposite them. The ribs 47 serve as stops for positioning the key 6 in its insertion position, so that its shuttering surface 40 is in the extension of the shuttering surfaces 13 of the section parts 2 and 5.

The key 6 consists of a main element 22 and two end elements 8 and 9 which are joined to the plate 23 of the said main element by the junction means already described (cylindrical tongues 15 fitted into hollow imprints 16) and which are connected to the core 25 of the said main element by means of connecting plates 34 and 35, and a plate 51 welded to these at 52 and bolted to the core 25 connects the entire assembly rigidly.

The plates 45 are connected to the end elements 8 or 9 of the section parts 2 and 5 and of the key 6 by means of an intermediate plate 53 (see FIG. 12) which on one side has a large plane face 54 and at the other side has attachment means compatible with those of an end element 8 or 9 (rib 36 provided with a rim 37 and a notch 38).

The length of the circumference of the wall section 1 can be matched exactly to the dimensions of the tunnel, since, in addition to the possibility of adding or removing a main element 7, 19, or 22, the plate width of which represents a basic module, it is also possible to insert one or more thickness plates 55 (FIG. 13) between a plate 45 and an intermediate plate 53. In FIG. 10, thickness plates 55 have been inserted between all the plates 45 and 53, but it is obvious that one or more of these thickness plates 55 can be omitted.

As illustrated, all the plates 45, 53 and, if appropriate, the thickness plate 55 are joined to the end element 8 or 9, to which they are connected, by means of a countersunk screw 56 passing through them.

Finally, the key 6 is equipped with sealing and sliding gaskets 57 and 58 respectively.

The sealing gaskets 57 are accommodated in the notches 49 of the plates 45 of the key 6. The purpose of these sealing gaskets 57 is to prevent the loss of grout as a result of infiltration towards the inside of the tunnel during concreting and prevent the formation of nests of gravel or other local defects in the concrete. Their purpose is also to protect the sliding surfaces 41, 42, 43 and 44 against soiling. These sealing gaskets 57 can be made of rubber or another polymer having similar properties.

Moreover, sliding gaskets 58 cover the sliding surfaces 43 and 44 of the key 6. These sliding gaskets 58 make it possible to unkey the entire section 1 which, after the casting of the concrete, undergoes elastic shrinkage attributable to the pressure acting on the outer shuttering surface 13 and generating stress in the joints between the key 6 and the adjacent section parts 2 and 5. The sliding gaskets 58 consist, for example, of a Teflon elastomer plate which ensures good distribution of the pressures, whilst at the same time allowing the possibility of sliding against the sliding surfaces 41, 42 of the ends of the section parts 2 and 5.

FIG. 14 is a perspective view, partially cut away, of a section part, showing main elements 22 joined together edge to edge by the junction means allowing articulation between adjacent elements (cylindrical tongue 15 fitting into a hollow imprint 16), and fixed rigidly to one another by the connection and locking means 10. The latter consist of a perforated flat bar 59 bent according to the desired arch curvature and fastened to each end of the stiffening core 25 by means of a countersunk screw 60 and a nut 61 (see FIG. 15) seated in the slot 21.

FIG. 14 also shows an end element 8 connected to the plate 23 of the last main element 22 by the junction means already described (cylindrical tongue 15 fitting into a hollow imprint 16) and connected to the stiffening core 25 of the same main element 23 by means of a connecting plate 35.

The end of the perforated flat bar 59 is welded to the connecting plate 35 at 62.

Each section 1 has, on either side, an end face perpendicular to the shuttering surface 13 and to the axis of the section. These end faces make it possible to transmit the longitudinal thrust forces generated as a result of the advance of the shield of the machine. These end faces are divided into arcs of a length equal to those of the section parts.

The end face of a section part consists of two superimposed tubes of square cross-section 63 and 64, between which is inserted a structural piece 65 of rectangular cross-section; the tubes 63 and 64 and the structural piece 65 are bent so as to match the curvature of the section part and have a length equal to the length of this section part. The tubes of square cross-section 63 are placed on blocks 66 arranged between the junction means and are fastened to the shuttering plates 23 by means of screws 67 (see also FIG. 15).

Ties 68 parallel to the axis of the section pass through the structural pieces 65 and connect the two end faces of a section part.

Finally, plates 69 are fastened to the tubes of square cross-section 63 and 64 by means of screws 70 and carry elastomer gaskets 71 which ensure good distribution of the pressures along the periphery of the shuttering sections and which also allow relative movement in the radial direction between two sections 1 joined end to end. The thickness of these gaskets is determined by the amount of relative movement of two successive sections.

The plates 69 have a notch intended for receiving a rubber sealing gasket 72, the purpose of which is to prevent the loss of grout during concreting as a result of infiltration towards the outside of the tunnel between the sections 1 joined end to end.

Figure 15:
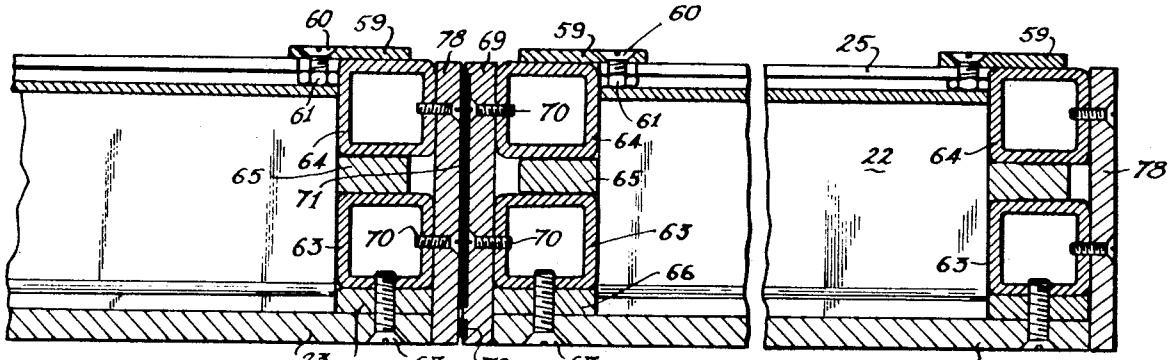
FIG. 15 is a cross-section through a main element along the axis of symmetry, showing the assembly of the section parts and the connection between two wall sections joined together end to end.

FIG. 15 is a cross-section through two wall sections 1 joined end to end and shows, in cross-section, the assembly of the end faces and the connection between two successive sections 1. This cross-section is taken in a plane passing through the plane of symmetry of a main element 22 perpendicularly relative to its shuttering plate 23.

Figure 16:
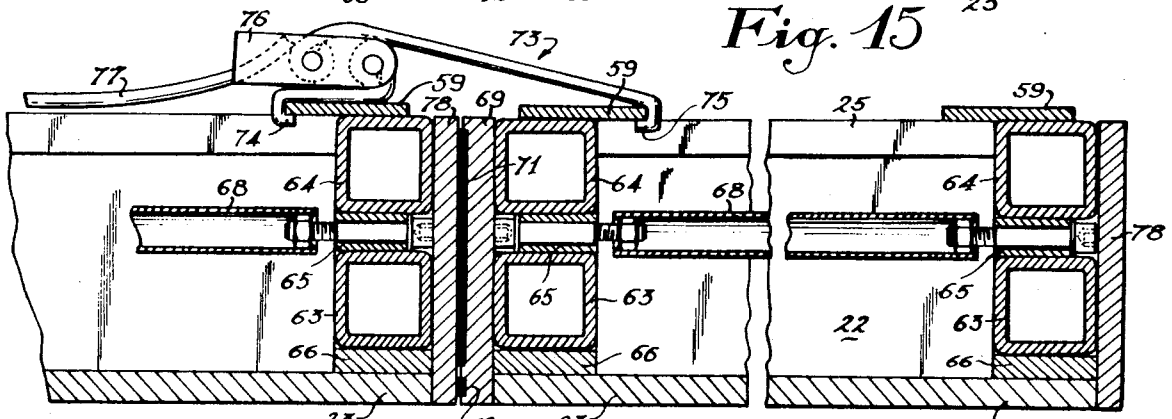
FIG. 16 is a cross-section along a plane passing between two adjacent main elements, through the point of assembly of two sections joined end to end.

Two shuttering sections 1 are joined end to end by the assembly means designated as a whole by the reference numeral 73 in FIG. 16. FIG. 16 is a cross-section through two wall sections 1 joined end to end; this crossthrough section is taken in a plane passing through an assembly tie 67 and perpendicular to the shuttering surface.

As can be seen, the assembly means is a toggle fastening comprising two claws 74 and 75 articulated on a body 76; the ends of each claw 74 and 75 are engaged under the flat bars 59 of the two sections, the body 76 being perpendicular to the claws 74, 75; the body 76 is subsequently folded down along one of the sections by means of a lever 77 integral with the body 76, the effect of which is to cross the joints and bring the ends of the claws 74, 75 closer towards one another, thereby clamping the sections axially to one another.

As can be seen in FIGS. 15 and 16, the plates 69 of the end face of a section, which carry the elastomer gaskets 71 and the rubber sealing gaskets 72, are laid against plates 78 having a plane surface, which are fastened to the end face of the following wall section, thus allowing the relative movements of the two end faces.

I claim:

1. Shutting and shoring wall having a cylindrical shuttering surface formed by joining end to end sections which each form a part of said wall limited by two planes perpendicular to the axes of said cylindrical surface, each section having at least one cambered part and consisting of at least two section parts joined together end to end, so that the joining edges are parallel to the axis of said cylindrical surface, and of at least one key (6) inserted between the surfaces of the ends of two section parts facing one another, wherein each section part itself consists of a certain number of identical pivotable main elements (7, 19, 22) and, at each of its ends, of an end element (8,9) and of connection and locking means (10), each main element (7, 19, 22) comprises a substantially rectangular shuttering plate (14, 23), one face of which forms the shuttering surface (13), the said plate (14, 23) being equipped, along two edges parallel to one another and to the axis of said cylindrical surface, with means of junction (15,16) with the edge of the adjacent plates (14, 23), the said junction means (15, 16) forming a joint about an axis running along the joined edges, each main element (7, 19, 22) further comprising an elongated stiffening core (17, 20, 25) which is spaced from the shuttering plate (14, 23) and is located on the same side as the face opposite the shuttering surface in a parallel direction to the axis of said cylindrical surface and which is connected rigidly to the shuttering plate (14, 23) by means of two connecting elements (18, 26), arranged to form a V, and extending between the stiffening core (17, 20, 25) and the edges of the shuttering plate (14, 23) which are parallel to the axis of the cylindrical surface, each end element (8, 9) likewise comprises a substantially rectangular shuttering plate (29, 30), one face of which forms the shuttering surface (13), and a stiffening plate (31, 32) which is spaced from the shuttering plate (29, 30) and is located on the same side as the face opposite the shuttering surface and which is connected rigidly to the shuttering plate (29, 30) by means of a web (39), each end element (8, 9) is attached to the shuttering plate (14, 23) of the last main element (7, 19, 22) of a section part by a junction means, and on its free end face it is profiled so as to allow connection and attachment to the end element (8,9) of another section part by a translation movement perpendicularly with respect to the axis of the cylindrical surface without rotation, the connection and locking means (10) connect the stiffening cores (17, 20, 25) and stiffening plates (31, 32) in such a way as to keep all the elements (7, 19, 22, 8, 9) of one and the same section part locked in a specific position relative to one another allowing each section part to reach a predetermined curvature radius, the key (6) has a shuttering surface (40) and two lateral insertion surfaces (43, 44), and the end elements (8, 9) adjacent to the key (6) are equipped with means (11, 12) of joining them to the key (6), which are compatible with the lateral insertion surfaces (43, 44) of the latter, so as to allow the key (6) to be inserted by a translation movement perpendicularly with respect to the axis of the cylindrical surface with the shuttering surface (40) at the front.

2. Wall as claimed in claim 1, wherein the junction means connecting the shuttering plates (14, 23) of the main elements (7, 19, 22) to one another and to the shuttering plates (29, 30) of the end elements (8, 9) of one and the same section part comprise, on the one hand, a solid cylindrical tongue (15) and, on the other hand, the hollow cylindrical imprint (16) of the same tongue (15), and shuttering plates (14, 23, 29, 30) of two adjacent elements (7, 19, 22, 8, 9) are joined together by fitting a tongue (15) of an element (7, 19, 22, 8, 9) into the hollow imprint (16) of an adjacent element (7, 19, 22, 8, 9) in a direction parallel to the axis of the section.

3. Wall as claimed in claim 2, wherein the shuttering plate (14, 23) of a main element (7, 19, 22) carries a solid cylindrical tongue (15) along one of the two parallel edges and the hollow cylindrical imprint (16) of the same tongue along the other edge.

4. Wall as claimed in claim 1, wherein the said connecting elements connecting the stiffening core (17, 20, 25) to the edges of the shuttering plate (14, 24) are solid webs (18, 26).

5. Wall as claimed in claim 1, wherein the said connecting elements connecting the stiffening core (17, 20, 25) to the edges of the shuttering plate (14, 24,) are reticular structures.

6. Wall as claimed in claim 1, wherein the said connecting elements connecting the stiffening core (17, 20, 25) to the shuttering plate (14, 23), form the said stiffening core (17, 20, 25) and integral V-shaped structure (24).

7. Wall as claimed in claim 6, wherein the shuttering plate (14) is connected to the integral V-shaped structure (24) by means of welding.

8. Wall as claimed in claim 6, wherein the shuttering plate (14) is connected to the integral V-shaped structure (24) by means of bonding.

9. Wall as claimed in claim 1, wherein the stiffening core (17, 20, 25) has a groove-shaped longitudinal slot (21) towards the side opposite the shuttering surface able to bear a fastening element for fastening said stiffening core to the connection and locking means (10).

10. Wall as claimed in claim 1, wherein the end elements (8, 9) are profiled so as to allow them to be attached to one another in the direction towards the shuttering surfaces, both along the edge of the shuttering plate (29, 30) and along the edge of the stiffening plate (31, 32).

11. Wall as claimed in claim 1, wherein the main elements (7, 19, 22), the end elements (8, 9) and the assembly means (11, 12) are made of metal.

12. Wall as claimed in claim 1, wherein the main elements (7, 19, 22), the end elements (8, 9) and the assembly means (11, 12) are made of polymer materials.

13. Wall as claimed in claim 12, wherein the main elements (7, 19, 22), the end elements (8, 9) and the assembly means (11, 12) are made of reinforced polymer materials.

14. Wall as claimed in claim 1, wherein the main elements (7,19, 22), the end elements (8, 9) and the assembly means (11, 12) are made of fibro-cement.

15. Shuttering and shoring wall having a cylindrical shuttering surface formed by joining end to end sections which each form a part of said wall limited by two planes perpendicular to the axes of said cylindrical surface, each section having at least one cambered part, each section consisting of at least two section parts joined together end to end, so that the joining edges are parallel to the axis of the section, and of at least one key inserted between the surfaces of the ends of two section parts facing one another, wherein each section part itself consists of a certain number of identical main elements (7, 19, 22) and, at each of its ends, of an end element (8, 9) and of connection and locking means (10), each main element (7, 19, 22) comprises a substantially rectangular shuttering plate (14, 23), one face of which forms the shuttering surface (13), and a stiffening core (17, 20, 25) which is spaced from the shuttering plate (I4, 23) and is located on the same side as the face opposite the shuttering surface and which is connected rigidly to the shuttering plate (14, 23), the said plate (14, 23) being equipped, along two edges parallel to one another and to the axis of the section, with means of junction with the edge of the adjacent plates (14, 23), the said junction means forming a joint about an axis running along the joined edges, each end element (8, 9) likewise comprises a substantially rectangular shuttering plate (29, 20), one face of which forms the shuttering surface, and a stiffening plate (31, 32) which is spaced from the shuttering plate (29, 30) and is lcoated on the same side as the face opposite the shuttering surface and which is connected rigidly to the shuttering plate (29, 30) by means of a web (39), each end element (8, 9) is attached to the shuttering plate (14, 23) of the last main element (7, 19, 22) of a section part by a junction means, and on the free end face it is profiled so as to allow connection and attachment to the end element (8, 9) of another section part, the connection and locking means (10) connect these stiffening cores (17, 20, 25) and stiffening plates (31, 32) in such a way as to keep all the elements (7, 19, 22, 8, 9) of one and the same section part locked in a specific position relateve to one another, the key (6) has a shuttering surface (40) and two lateral insertion surfaces (43, 44), and the end elements (8, 9) adjacent to the key (6) are equipped with means (11, 12) of joining them to the key (6), which are compatible with the lateral insertion surfaces (43, 44) of the latter, so as to allow the key (6) to be inserted with the shuttering surface (40) at the front, wherein the connecting elements and the stiffening core (17, 20, 25) form an integeral V-shaped structure (24), that connects the stiffening core (17, 20, 25) to shuttering plate (14, 23) and the shuttering plate (23) carries, on its face opposite the shuttering surface, two parallel ribs equipped with a solid cylindrical tongue (27) along their free edge, and the free edge of each of the connecting elements of the integral V-shaped structure (24) is provided with a hollow imprint (28) of the said tongue (27), and the fitting of the said two tongues (27) into the said imprints (28) allow the assembly of a main element (22).

16. Shuttering and shoring wall having a cylindrical shuttering surface formed by joining end to end sections which each form a part of said wall limited by two planes perpendicular to the axes of said cylindrical surface, each section having at least one cambered part, each section consisting of at least two section parts joined together end to end, so that the joining edges are parallel to the axis of the section, and of at least one key inserted between the surfaces of the ends of two section parts facing one another, wherein each section part itself consists of a certain number of identical main elements (7, 19, 22) and, at each of its ends, of an end element (8,9) and of connection and locking means (10), each main element (7, 19, 22) comprises a substantially rectangular shuttering plate (14, 23), one face of which forms the shuttering surface (13), and a stiffening core (I7, 20, 25) which is spaced from the shuttering plate (14, 23) and is located on the same side as the face opposite the shuttering surface and which is connected rigidly to the shuttering plate (14, 23), the said plate (14, 23) being equipped, along two edges parallel to one another and to the axis of the section, with means of junction with the edge of the adjacent plates (14, 23), the said junction means forming a joint about an axis running along the joined edges, each end element (8, 9) likewise comprises a substantially rectangular shuttering plate (29, 30), one face of which forms the shuttering surface, and a stiffening plate (31, 32) which is spaced from the shuttering plate (29, 30) and is located on the same side as the face opposite the shuttering surface and which is connected rigidly to the shuttering plate (29, 30) by means of a web (39), each end element (8, 9) is attached to the shuttering plate (14, 23) of the last main element (7, 19, 22) of a section part by a junction means, and on the free end face it is profiled so as to allow connection and attachment to the end element (8, 9) of another section part, the connection and locking means (10) connect these stiffening cores (17, 20, 25) and stiffening plates (31, 32) in such a way as to keep all the elements (7, 19, 22, 8, 9) of one and the same section part locked in a specific position relative to one another, the key (6) has a shuttering surface (40) and two lateral insertion surfaces (43, 44), and the end elements (8, 9) adjacent to the key (6) has a shuttering surface (40) and two lateral insertion surfaces (43, 44), and the end elements (8,9) adjacent to the key (6) are equipped with means (11, 12) of joining them to the key (6), which are compatible with the lateral insertion surfaces (43, 44) of the latter, so as to allow the key (6) to be inserted with the shuttering surface (40) at the front, wherein the end elements (8, 9) are profiled so as to allow them to be attached to one another in the direction towards the shuttering surfaces, both along the edge of the shuttering plate (29, 30) and along the edge of the stiffening plate (31, 32), and on one of the end elements (9), the means of attachment along the edge of the shuttering plate (29) consists of a rib (36) equipped with a rim (37), and the means of attachment along the edge of the stiffening plate (31) consists of a notch (38), and, on the other end element (8), the means of attachment along the edge of the shuttering plate (30) consists of notch (38) intended for receiving the rim (37) of the first end element (9), and the means of attachment along the edge of stiffening plate (32) consists of a rib (36) equipped with a rim (37) intended to be engaged in the notch (38) of the first end element (9).

17. Wall as claimed in claim 16, wherein each of the end elements (8, 9) consists of a structural piece (33) comprising two plates (29, 30) which are connected by means of a web (39) perpendicular to these and of which one forms the shuttering plate (29, 30) and the other is joined to a matching connecting plate (34, 35) to form the stiffening plate (31, 32), and along their edges located on the same side as the main element (7, 19, 22) one of the plates (29, 30) has a solid longitudinal tongue (15) and the other the hollow imprint (16) of the same tongue (15), and moreover, on the side where the elements (8, 9) are attached to one another, one of the two plates (29, 30) has a rib (36) equipped with a rim (37) and the other has a notch (38), the said structural piece (33) thus making it possible, by being rotated through 180°, equally to joined it to a shuttering plate (16) or a tongue (15) and attach two end elements (8, 9) to one another.

18. Shuttering and shoring wall having a cylindrical shuttering surface formed by joining end to end sections which each form a part of said wall limited by two planes perpendicular to the axes of said cylindrical surface, each section having at least one cambered part, each section consisting of at least two section parts joined together end to end, so that the joining edges are parallel to the axis of the section, and of at least one key inserted between the surfaces of the ends of two section parts facing one another, wherein each section part itself consists of a certain number of identical main elements (7, 19, 22) and, at each of its ends, of an end element (8, 9) and of connection and locking means (10), each main element (7, 19, 22) comprises a substantially rectangular shuttering plate (14, 23), one face of which forms the shuttering surface (13), and a stiffening core (17, 20, 25) which is spaced from the shuttering plate (14, 23) and is located on the same side as the face opposite the shuttering surface and which is connected rigidly to the shuttering plate (14, 23), the said plate (14, 23) being equipped, along two edges parallel to one another and to the axis of the section, with means of junction with the edge of the adjacent plates (14, 23), the said junction means forming a joint about an axis running along the joined edges, each end element (8, 9) likewise comprises a substantially rectangular shuttering plate (29, 30), one face of which forms the shuttering surface, and a stiffening plate (31, 32) which is spaced from the shuttering plate (29, 30) and is located on the same side as the face opposite the shuttering surface and which is connected rigidly to the shuttering plate (29, 30) by means of a web (39), each end element (8, 9) is attached to the shuttering plate (14, 23) of the last main element (7, 19, 22) of a section part by a junction means, and on the free end face it is profiled so as to allow connection and attachment to the end element (8, 9) of another section part, the connection and locking means (10) connect these stiffening cores (17, 20, 25) and stiffening plates (31, 32) in such a way as to keep all the elements (7, 19, 22, 8, 9) of one and the same section part locked in a specific position relateve to one another, the key (6) has a shuttering surface (40) and two lateral insertion surfaces (43, 44), and the end elements (8, 9) adjacent to the key (6) are equipped with means (11, 12) of joining them to the key (6), which are compatible with the lateral insertion surfaces (43, 44) of the latter, so as to allow the key (6) to be inserted with the shuttering surface (40) at the front, wherein the key (6) consists of a main element (7, 19, 22) and two end elements (8, 9), each carrying a plate (45), one face of which forms a sliding surface (43, 44) allowing the key (6) to be inserted, each plate (45) being connected to the nearest end element (8, 9, by means of an intermediate plate (53), one of the faces of which is equipped with means of attachment to this end element (8, 9).

19. Wall as claimed in claim 18, wherein the means (11, 12) of joining the end elements (8, 9) to the key (6) each consist of a plate (45), one face of which forms a sliding surface (41, 42) compatible with one of the sliding surfaces (43,44) of the key (6), and of an intermediate plate (53) allowing attachment to the nearest end element (8, 9).

* * * * *